US008088324B2

(12) United States Patent
Andrady et al.

(10) Patent No.: US 8,088,324 B2
(45) Date of Patent: Jan. 3, 2012

(54) ELECTROSPRAY/ELECTROSPINNING APPARATUS AND METHOD

(75) Inventors: Anthony L. Andrady, Apex, NC (US); David S. Ensor, Chapel Hill, NC (US)

(73) Assignee: Research Triangle Institute, Research Triangle Park, NC (US)

( * ) Notice: Subject to any disclaimer, the term of this patent is extended or adjusted under 35 U.S.C. 154(b) by 31 days.

(21) Appl. No.: 12/825,656

(22) Filed: Jun. 29, 2010

(65) Prior Publication Data

US 2011/0031638 A1 Feb. 10, 2011

Related U.S. Application Data

(62) Division of application No. 10/819,942, filed on Apr. 8, 2004, now Pat. No. 7,762,801.

(51) Int. Cl.
*B29C 47/30* (2006.01)

(52) U.S. Cl. ..... 264/465; 264/484; 264/29.2

(58) Field of Classification Search ..... 264/465, 264/484, 29.2

See application file for complete search history.

(56) References Cited

U.S. PATENT DOCUMENTS

| | | | |
|---|---|---|---|
| 705,691 | A | 7/1902 | Morton |
| 1,975,504 | A | 10/1934 | Formhals |
| 2,048,651 | A | 7/1936 | Norton |
| 2,160,962 | A | 6/1939 | Formhals |
| 2,187,306 | A | 1/1940 | Formhals |
| 2,323,025 | A | 6/1943 | Formhals |
| 2,349,950 | A | 5/1944 | Formhals |
| 3,049,753 | A | 6/1962 | Ogden et al. |
| 3,280,229 | A | 10/1966 | Simons |
| 3,475,198 | A | 10/1969 | Drum |
| 3,490,115 | A | 1/1970 | Owens et al. |
| 3,670,486 | A | 6/1972 | Murray, Jr. |
| 3,901,012 | A | 8/1975 | Safar |
| 3,994,258 | A | 11/1976 | Simm |
| 4,044,404 | A | 8/1977 | Martin et al. |
| 4,127,706 | A | 11/1978 | Martin et al. |
| 4,230,650 | A | 10/1980 | Guignard |
| 4,323,525 | A | 4/1982 | Bornat |

(Continued)

FOREIGN PATENT DOCUMENTS

EP 1 217 107 A1 6/2002

(Continued)

OTHER PUBLICATIONS

European Search Report. Date Unknown.

*Primary Examiner* — Michael Tolin

(74) *Attorney, Agent, or Firm* — Oblon, Spivak, McClelland, Maier & Neustadt, L.L.P.

(57) ABSTRACT

Apparatus and method for producing fibrous materials in which the apparatus includes an enclosure having an inlet configured to receive a substance from which the fibrous materials are to be composed, a common electrode disposed in the enclosure, and plural extrusion elements provided in a wall of the enclosure opposite the common electrode so as to define between the plural extrusion elements and the common electrode a space in communication with the inlet to receive the substance in the space. In the method, a substance from which the fibrous materials are to be composed is fed to the enclosure having the plural extrusion elements, a common electric field is applied to the extrusion elements in a direction in which the substance is to be extruded, the substance is extruded through the extrusion elements to tips of the extrusion elements, and the substance is electrosprayed from the tips to form the fibrous materials.

10 Claims, 13 Drawing Sheets

U.S. PATENT DOCUMENTS

| | | | |
|---|---|---|---|
| 4,345,414 | A | 8/1982 | Bornat et al. |
| 4,468,922 | A | 9/1984 | McCrady et al. |
| 4,552,707 | A | 11/1985 | How |
| 4,618,524 | A | 10/1986 | Groitzsch et al. |
| 4,689,186 | A | 8/1987 | Bornat |
| 4,878,908 | A | 11/1989 | Martin et al. |
| 4,965,110 | A | 10/1990 | Berry |
| 5,024,789 | A | 6/1991 | Berry |
| 5,088,807 | A | 2/1992 | Waters et al. |
| 5,522,879 | A | 6/1996 | Scopelianos |
| 5,866,217 | A | 2/1999 | Stenoien et al. |
| 5,932,165 | A | 8/1999 | Corbet et al. |
| 6,099,960 | A | 8/2000 | Tennent et al. |
| 6,106,913 | A | 8/2000 | Scardino et al. |
| 6,110,590 | A | 8/2000 | Zarkoob et al. |
| 6,265,333 | B1 | 7/2001 | Dzenis et al. |
| 6,265,466 | B1 | 7/2001 | Glatkowski et al. |
| 6,306,424 | B1 | 10/2001 | Vyakarnam et al. |
| 6,308,509 | B1 | 10/2001 | Scardino et al. |
| 6,375,886 | B1 | 4/2002 | Angadjivand et al. |
| 6,382,526 | B1 | 5/2002 | Reneker et al. |
| 2005/0087637 | A1 | 4/2005 | Keller et al. |

FOREIGN PATENT DOCUMENTS

| | | | |
|---|---|---|---|
| EP | 1 226 795 | A2 | 7/2002 |
| EP | 1 277 857 | A1 | 1/2003 |
| JP | 2002-201559 | | 7/2002 |
| JP | 2002-249966 | | 9/2002 |
| JP | 2007-517991 | A | 7/2007 |
| WO | WO 98/03267 | | 1/1998 |
| WO | WO 01/15754 | A1 | 3/2001 |
| WO | WO 01/26610 | A1 | 4/2001 |
| WO | WO 01/26702 | A2 | 4/2001 |
| WO | WO 01/27365 | A1 | 4/2001 |
| WO | WO 01/27368 | A1 | 4/2001 |
| WO | WO 01/51690 | A1 | 7/2001 |
| WO | WO 01/68228 | A1 | 9/2001 |
| WO | WO 01/74431 | A2 | 10/2001 |
| WO | WO 01/89022 | A1 | 11/2001 |
| WO | WO 01/89023 | A1 | 11/2001 |
| WO | WO 02/16680 | A1 | 2/2002 |
| WO | WO 02/34986 | A2 | 5/2002 |
| WO | WO 02/49535 | A2 | 6/2002 |
| WO | WO 02/49536 | A2 | 6/2002 |
| WO | WO 02/49678 | A2 | 6/2002 |
| WO | WO 02/072937 | A1 | 9/2002 |
| WO | WO 02/074189 | A2 | 9/2002 |
| WO | WO 02/074191 | A2 | 9/2002 |
| WO | WO 02/092339 | A1 | 11/2002 |
| WO | WO 02/092888 | A1 | 11/2002 |
| WO | WO 03/004735 | A1 | 1/2003 |
| WO | WO 03/062510 | A1 | 7/2003 |
| WO | WO 03/076701 | A1 | 9/2003 |
| WO | WO 2004/016839 | A1 | 2/2004 |
| WO | WO 2005/073441 | A1 | 8/2005 |

ELECTROSPRAY/ELECTROSPINNING APPARATUS AND METHOD

CROSS REFERENCE TO RELATED APPLICATIONS

This application is a Divisional of application Ser. No. 10/819,942, filed Apr. 8, 2004 now U.S. Pat. No 7,762,801, entitled "Electrospray/Electrospinning Apparatus and Method", which is incorporated herein by reference. application Ser. No. 10/819,942 is related to U.S. application Ser. No. 10/819,916, filed on Apr. 8, 2004, entitled "Electrospinning of Fibers Using a Rotating Spray Head", the entire contents of which are incorporated herein by reference. This application is related to U.S. application Ser. No. 10/819,945, filed on Apr. 8, 2004, entitled "Electrospinning in a Controlled Gaseous Environment", the entire contents of which are incorporated herein by reference.

DISCUSSION OF THE BACKGROUND

1. Field of the Invention

This invention relates to the field of electrospraying and electrospinning of fibers or fibrous materials from polymer solutions.

2. Background of the Invention

Nanofibers are useful in a variety of fields from clothing industry to military applications. For example, in the biomaterial field, there is a strong interest in developing structures based on nanofibers that provide a scaffolding for tissue growth effectively supporting living cells. In the textile field, there is a strong interest in nanofibers because the nanofibers have a high surface area per unit mass that provides light but highly wear-resistant garments. As a class, carbon nanofibers are being used for example in reinforced composites, in heat management, and in reinforcement of elastomers. Many potential applications for nanofibers are being developed as the ability to manufacture and control their chemical and physical properties improves.

Electrospray/electrospinning techniques are used to form particles and fibers as small as one nanometer in a principal direction. The phenomenon of electrospray involves the formation of a droplet of polymer melt at an end of a needle, the electric charging of that droplet, and an expulsion of parts of the droplet because of the repulsive electric force due to the electric charges. In electrospraying, a solvent present in the parts of the droplet evaporates and small particles are formed but not fibers. The electrospinning technique is similar to the electrospray technique. However, in electrospinning and during the expulsion, fibers are formed from the liquid as the parts are expelled.

Glass fibers have existed in the sub-micron range for some time. Small micron diameter electrospun nanofibers have been manufactured and used commercially for air filtration applications for more than twenty years. Polymeric melt blown fibers have more recently been produced with diameters less than a micron. Several value-added nonwoven applications, including filtration, barrier fabrics, wipes, personal care, medical and pharmaceutical applications may benefit from the interesting technical properties of commercially available nanofibers and nanofiber webs. Electrospun nanofibers have a dimension less than 1 μm in one direction and preferably a dimension less than 100 nm in this direction. Nanofiber webs have typically been applied onto various substrates selected to provide appropriate mechanical properties and to provide complementary functionality to the nanofiber web. In the case of nanofiber filter media, substrates have been selected for pleating, filter fabrication, durability in use, and filter cleaning.

A basic electrospinning apparatus 10 is shown in FIG. 1 for the production of nanofibers. The apparatus 10 produces an electric field 12 that guides a polymer melt or solution 14 extruded from a tip 16 of a needle 18 to an electrode 20. An enclosure/syringe 22 stores the polymer solution 14. Conventionally, one end of a voltage source HV is electrically connected directly to the needle 18, and the other end of the voltage source HV is electrically connected to the electrode 20. The electric field 12 created between the tip 16 and the electrode 20 causes the polymer solution 14 to overcome cohesive forces that hold the polymer solution together. A jet of the polymer 14 is drawn from the tip 16 toward the electrode 20 by the electric field 12 (i.e. electric field extracted), and dries during flight from the needle 18 to the electrode 20 to form polymeric fibers, which can be collected downstream on the electrode 20.

The electrospinning process has been documented using a variety of polymers. One process of forming nanofibers is described for example in *Structure Formation in Polymeric Fibers*, by D. Salem, Hanser Publishers, 2001, the entire contents of which are incorporated herein by reference. By choosing a suitable polymer and solvent system, nanofibers with diameters less than 1 micron can be made.

Examples of fluids suitable for electrospraying and electrospinning include molten pitch, polymer solutions, polymer melts, polymers that are precursors to ceramics, and/or molten glassy materials. These polymers can include nylon, fluoropolymers, polyolefins, polyimides, polyesters, and other engineering polymers or textile forming polymers. A variety of fluids or materials besides those listed above have been used to make fibers including pure liquids, solutions of fibers, mixtures with small particles and biological polymers. A review and a list of the materials used to make fibers are described in U.S. Patent Application Publications US 2002/0090725 A1 and US 2002/0100725 A1, and in Huang et al., Composites Science and Technology, v63, 2003, the entire contents of which are incorporated herein by reference. U.S. Patent Application Publication No. US 2002/0090725 A1 describes biological materials and bio-compatible materials to be electroprocessed, as well as solvents that can be used for these materials. U.S. Patent Application Publication No. US 2002/0100725 A1 describes, besides the solvents and materials used for nanofibers, the difficulties of large scale production of the nanofibers including the volatilization of solvents in small spaces. Huang et al. give a partial list of materials/solvents that can be used to produce the nanofibers.

Further, U.S. Pat. No. 3,280,229, the entire contents of which are incorporated herein by reference, describes metal needles for electrospinning via single or multiple electrified needles. Alternatively, electrospinning can occur from a receptor having a narrow end through which the fluid can exit the receptor and a long pointed electrode immersed in the fluid to electrify the fluid. For example, U.S. Pat. No. 705,691, the entire contents of which are incorporated herein by reference, describes a simple spray head as described above.

Further, U.S. Patent Application Publication Nos. US 2002/0007869A1, US 2002/0090725A1, US 2002/0100725A1, US 2002/0122840A1, and US 2002/0175449A1, the entire contents of which are incorporated herein by reference, describe a plurality of electrified needles used to increase a spray area for nanofiber production. These patent applications disclose methods by which a polymer fiber is distributed to a plurality of needles, each needle being connected to one or more conductive boards that have a high voltage. For example, U.S. Patent Application Publication No. US 2002/0122840A1 shows an apparatus for electrospinning in FIG. 2*a* in which two conductor boards 26 and 30 make electrical contact to each needle 32. A high voltage is applied to each needle 32 through the conductor boards 26 and 30 that are in direct contact with the needles. Further, both U.S. Patent Publication Appl. No. 2002/0122840A1 and U.S. Pat. Publication Appl. No. US2002/0175449A1, describe electrospinning of polymer solutions through one or more charged conducting nozzles arranged on at least one conducting plate.

Hence, the background techniques using a multiplicity of individually electrified needles and/or a multiplicity of solution reservoirs are not conducive to large scale manufacturing. The number of controls necessary to control the electrical field at each needle scales with the number of needles, which may easily exceeds 100 needles for large scale production. Further, the control and delivery of the polymer solutions separately to each needle reservoir complicate the scale up to large scale nanofiber production.

SUMMARY OF THE INVENTION

One object of the present invention is to provide an apparatus and a method for the production of fibers and/or fibrous materials conducive to mass production.

Another object is to provide an apparatus and a method which produce fibers and/or fibrous materials in a parallel production process that ameliorate the deficiencies of the background art discussed above.

Accordingly, a further object of the present invention is to provide an apparatus and a method which simultaneously extrudes a plurality of fibers and/or fibrous materials from an electrospray head.

Thus, according to one aspect of the present invention, there is provided a novel apparatus for producing fibrous materials, including an enclosure having an inlet configured to receive a substance from which the fibrous materials are to be composed, a common electrode disposed in the enclosure, and plural extrusion elements provided in a wall of the enclosure opposite the common electrode so as to define between the plural extrusion elements and the common electrode a space in communication with the inlet to receive the substance in the space.

According to a second aspect of the present invention, there is provided a novel method that feeds a substance from which the fibers are to be composed to the enclosure having the plural extrusion elements, applies a common electric field to the extrusion elements in a direction in which the substance is to be extruded, extrudes the substance through the plural extrusion elements to tips of the extrusion elements, and electrosprays the substance from the tips to form the fibrous materials.

extrudes the substance through the extrusion elements in the common electric field.

BRIEF DESCRIPTION OF THE DRAWINGS

A more complete appreciation of the present invention and many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 2:
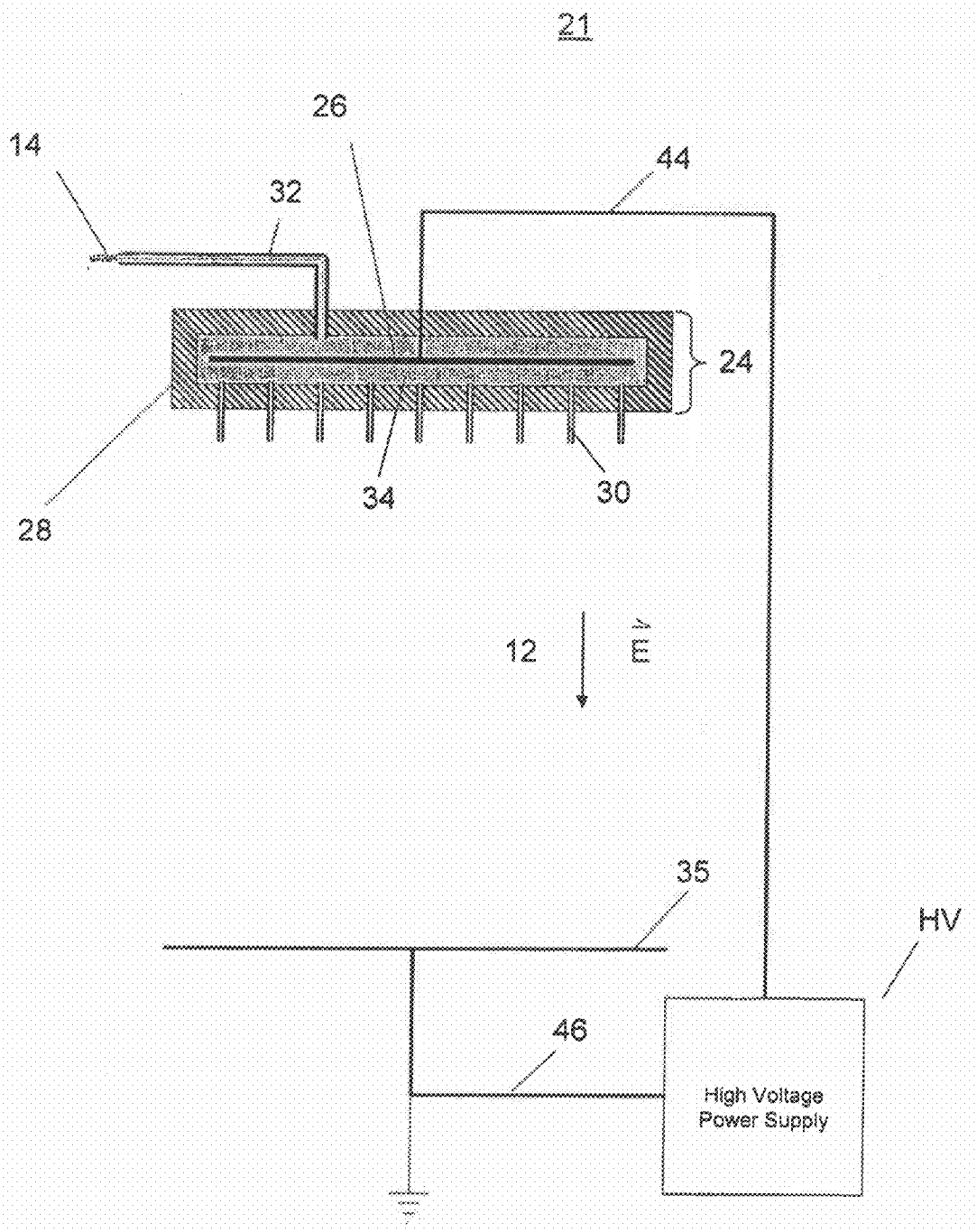
FIG. 2 is a schematic illustration of an electrospray/electrospinning apparatus according to one embodiment of the present invention.

Referring now to the drawings, wherein like reference numerals designate identical, or corresponding parts throughout the several views, and more particularly to FIG. 2, FIG. 2 is a schematic illustration of an electrospray/electrospinning apparatus 21 for producing fibers and/or fibrous materials. As used herein, the term fibrous materials denotes material both electrosprayed as short fibers and material electrospun into longer continuous fibers. According to one embodiment of the present invention, a spray head 24 includes an electrode 26 enclosed within an enclosure 28. The enclosure 28 can be made either of an insulating material or an electrically permeable material. The spray head 24 includes an array of extrusion elements 30 and a passage 32 for supplying an electrospray medium 14 to the array of spray openings 30. The extrusion elements 30 are provided in a wall of the enclosure 28 opposite the electrode 26 so as to define between the extrusion elements 30 and the electrode 26 a space 34 in communication with the passage 32 (inlet) to the enclosure 28 to receive the electrospray medium 14 (i.e. an extrudable material) in the space 34. The electrospray medium 14 includes polymer solutions and/or melts known in the art for the extrusion of fibers including extrusions of nanofiber materials. Indeed, polymers and solvents suitable for the present invention include for example polystyrene in dimethylformamide or toluene, polycaprolactone in dimethylformamide/methylene chloride mixture (20/80 w/w), polyethyleneoxide in distilled water, polyacrylic acid in distilled water, poly (methyl methacrylate) PMMA in acetone, cellulose acetate in acetone, polyacrylonitrile in dimethylformamide, polylactide in dichloromethane or dimethylformamide, and polyvinylalcohol in distilled water.

The electrode 26 in one embodiment of the present invention is centered within the enclosure and forms a common electrode producing a common electric field for extruding the electrospray medium. Preferably, the electrode 26 can be disposed close to but not in contact with the extrusion elements 30. An exterior electrode 35 is provided outside the enclosure 28 facing the electrode 26. An electric potential across to the electrodes 26 and 35 establishes an electric field 12 as shown in FIG. 2 which extends through and beyond the enclosure 28 to the exterior electrode 35. The geometrical arrangement of the electrode 26 and the exterior electrode 35 configures the electric field strength and distribution. The electrospray medium 14, upon extrusion from the extrusion elements 30, is guided along a direction of the electric field 12 toward the exterior electrode 35.

In one embodiment of the present invention, the spray head 24 preferably includes individual extrusion elements 30 such as for example capillaries, bundles of capillaries, needles, bundles of needles, tubes, bundles of tubes, rods, bundles of rods, concentric tubes, frits, open-cell foams, combinations thereof, or otherwise channels of appropriate shape formed in a wall of the enclosure 28. The individual extrusion elements can be made of metal, glass, or plastic capillary tubes appropriately sized to deliver the electrospray medium 14 from the spray head 24 to an exterior of the spray head 24, where the electrospray medium 14 is electrified. Further, the extrusion elements 30, in one embodiment of the present invention, as shown in FIG. 2 do extend beyond the enclosure 28. However, the spray elements in another embodiment do not extend beyond an exterior wall of the enclosure 28. Each extrusion element 30 has a first opening inside the enclosure 28 and a second opening outside the enclosure 28.

Figure 2A:
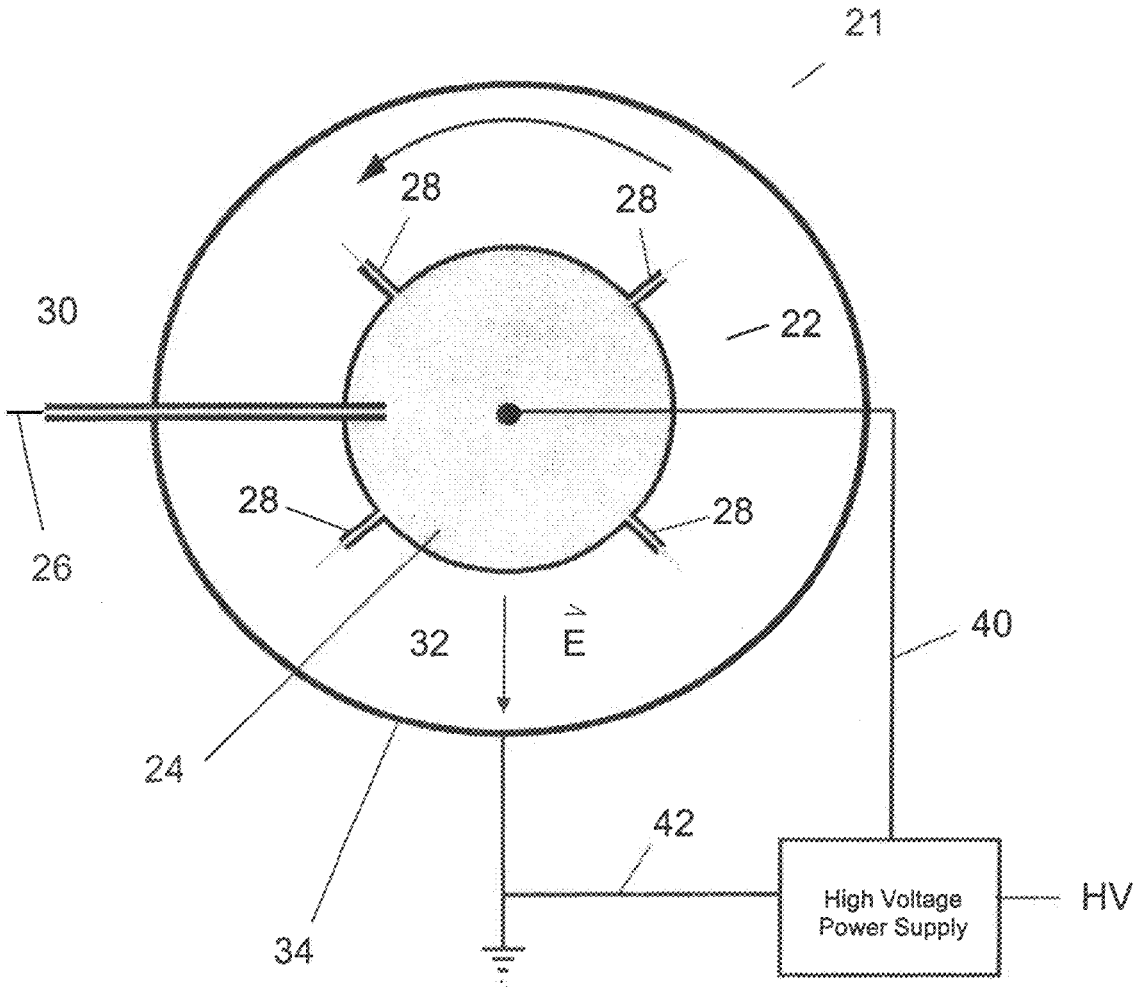
FIG. 2A is a schematic illustration showing a top view of a rotatable spray head electrospinning apparatus.

FIG. 2A is a schematic illustration of an embodiment of the invention showing a top view of a rotatable spray head electrospinning apparatus.

Figure 3A:
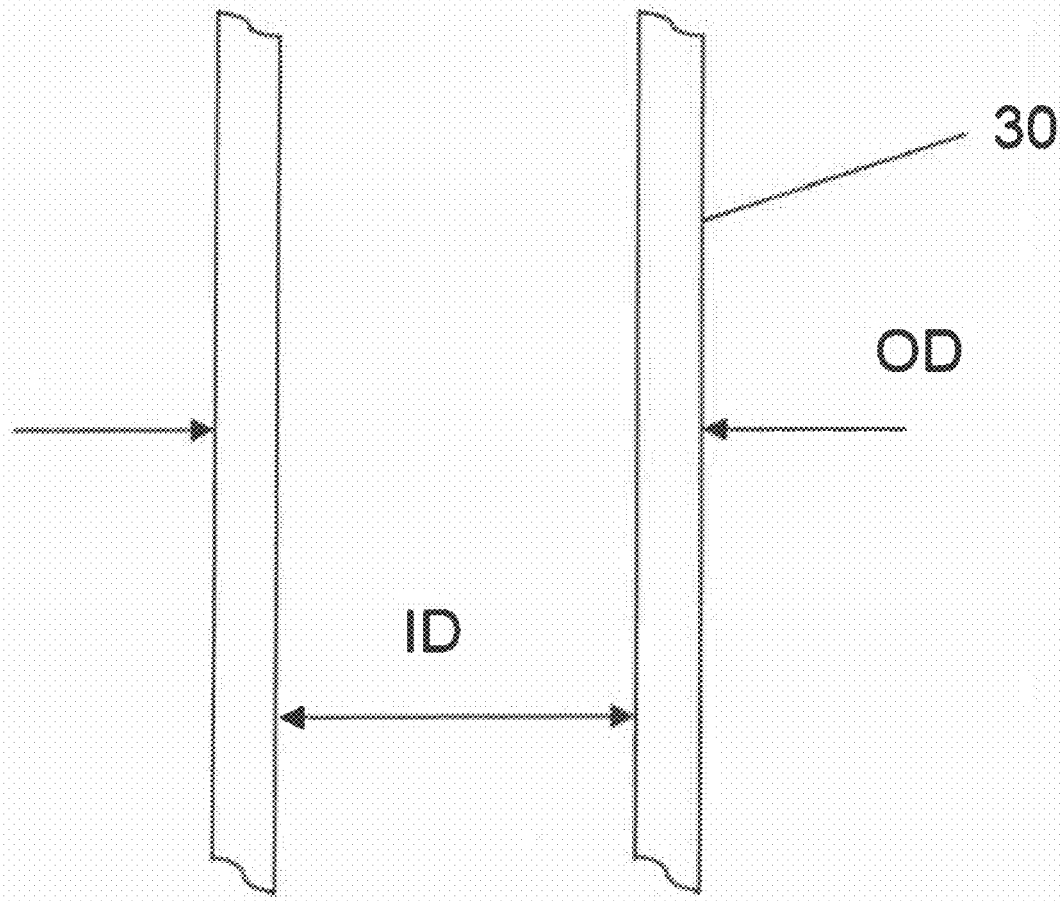
FIG. 3A is a schematic illustration of one embodiment of an extrusion element of the present invention.
Figure 3B:
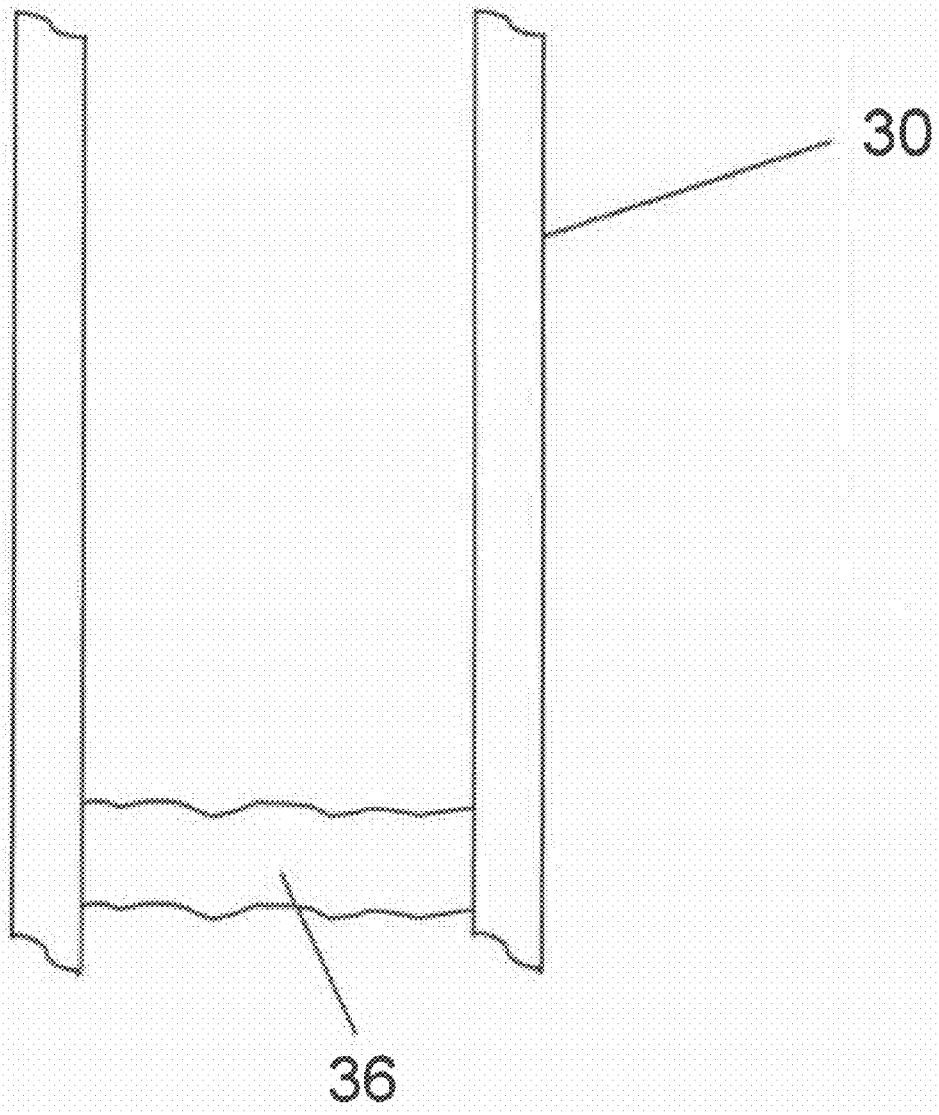
FIG. 3B is a schematic illustration of another embodiment of an extrusion element of the present invention.

FIG. 3A shows for example an extrusion element 30 which has an inner diameter ID between 50-250 μm and an outer diameter OD about 260 μm. Other cross-section shapes as for example a rectangular cross-section are also applicable for tubes, capillaries, needles, channels, etc. An inner dimension of 50 to 250 μm facilitates the electrospraying of nanofibers. Inner dimensions less than 400 μm for rectangular cross-sections are preferred. In another example, FIG. 3B shows a tube 30 having a frit 36 that covers an opening of the tube 30. A pump (not shown) maintains a flow rate of the electrospray substance 14 through each element 30 at a desired value depending on capillary diameter and length, the number of capillaries, and a viscosity of the electrospray substance. A filter can be placed between the pump and the enclosure 28 to filter out impurities and/or particles having a dimension larger than a predetermined dimension of the extrusion element 30. Also, a flow rate through each element should be balanced with an electric field strength so that a droplet shape exiting the capillary is maintained constant. Using the Hagen-Poiseuille law, a pressure drop through a capillary having an inner diameter of 100 μm and a length of about 1 cm is approximately 100-700 kPa for a flow rate of 1 ml/hr depending on the viscosity of the substance.

Generally, smaller diameter tubes yield a narrower nanofiber. Also, while multiple tubes (spray heads) can be accommodated in a single device, a certain minimum distance must be allowed between the adjacent tubes to avoid electrical interference between them. The minimum distance varies with one or more of the polymer/solvent system used, the electric field density, and the tube diameter. Tubes placed too close to each other can cause slower solvent removal rates affecting the fiber quality.

The extrusion elements 30, in one embodiment of the present invention, are arrayed in channels placed adjacent or close to each other in one or more directions. These channels can be bundles of individual members in the form, for example, capillaries or rods close to each other. The individual members can be made of, for example, non-conducting materials such as glass, ceramic, Teflon, or polyethylene but also of conducting materials. The use of a multiplicity of electrically insulating extrusion elements 30 made of electrically insulating or non-conducting materials does not alter the electric field 12 established between the electrode 26 and the exterior electrode 35.

Figure 4:
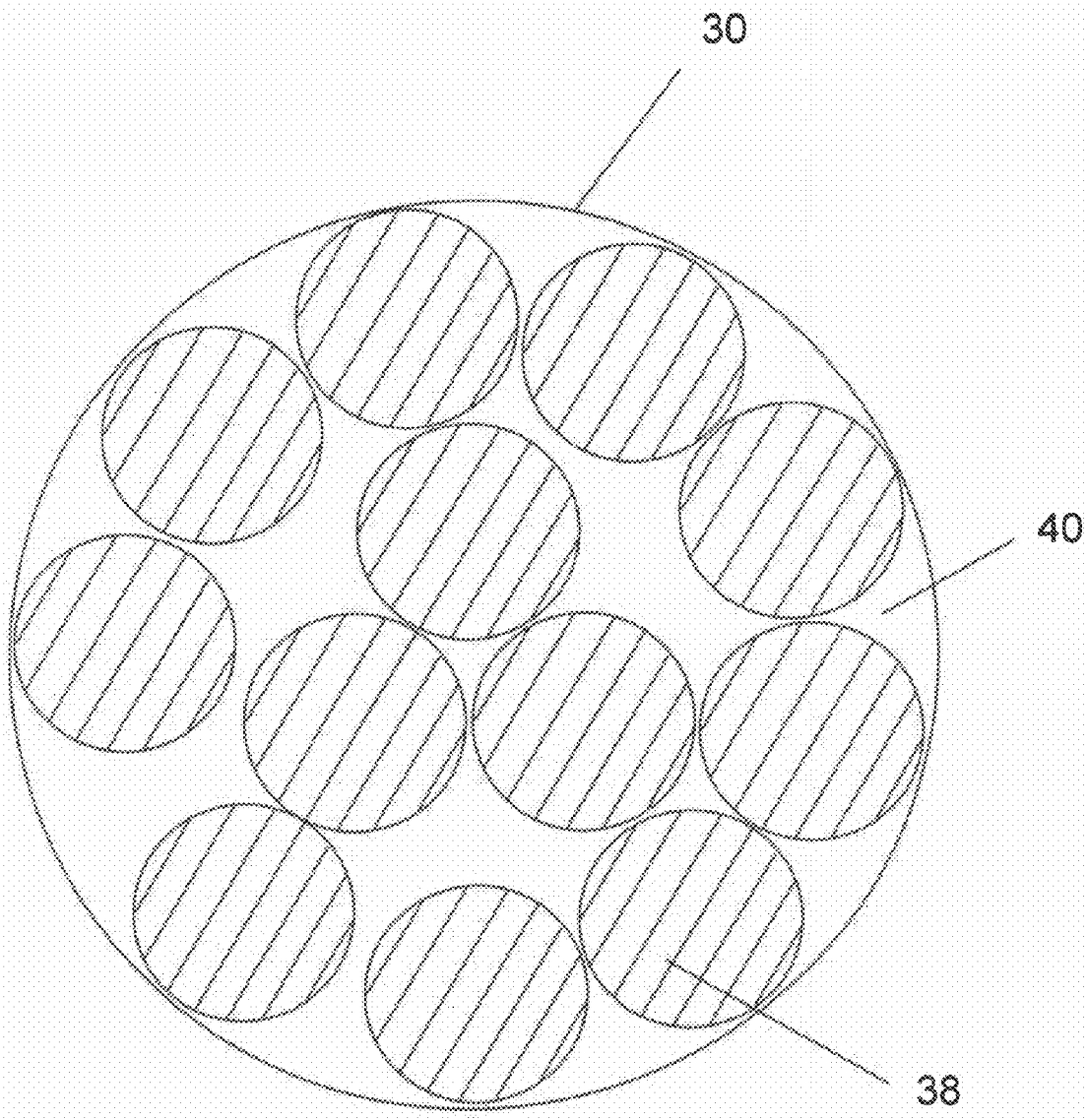
FIG. 4 is a schematic illustration of an extrusion element according to one embodiment of the present invention in which solid members form channels for the extrusion elements.

In another embodiment shown in FIG. 4, channels for spraying or spinning the electrospray medium 14 are formed as the extrusion elements 30. The channels are formed by placing (metal) needles or solid wires against each other to define extrusion channels between the needles or solid wires. For example, as shown in FIG. 3B, a plurality of solid wires 38 are placed next to each other to form channels 40 through which the electrospray medium 14 flows. Still, another embodiment of the present invention uses bundles of capillaries of either conducting or non-conducting material. Still another embodiment of the present invention forms the channels using frits made of glass, ceramic, metal or organic material or micro-machines holes with an appropriate configuration in a base plate of the electrospray head 24. The machined plate, if silicon, can be subsequently oxidized to form silicon dioxide and then attached as a bottom part of the enclosure 28. Still another embodiment of the present invention forms channels through the enclosure 28 using open cell foams made of any organic or inorganic materials as the bottom part of the enclosure 28. The above described embodiments describe a few non-limiting examples of the present invention.

Figure 5:
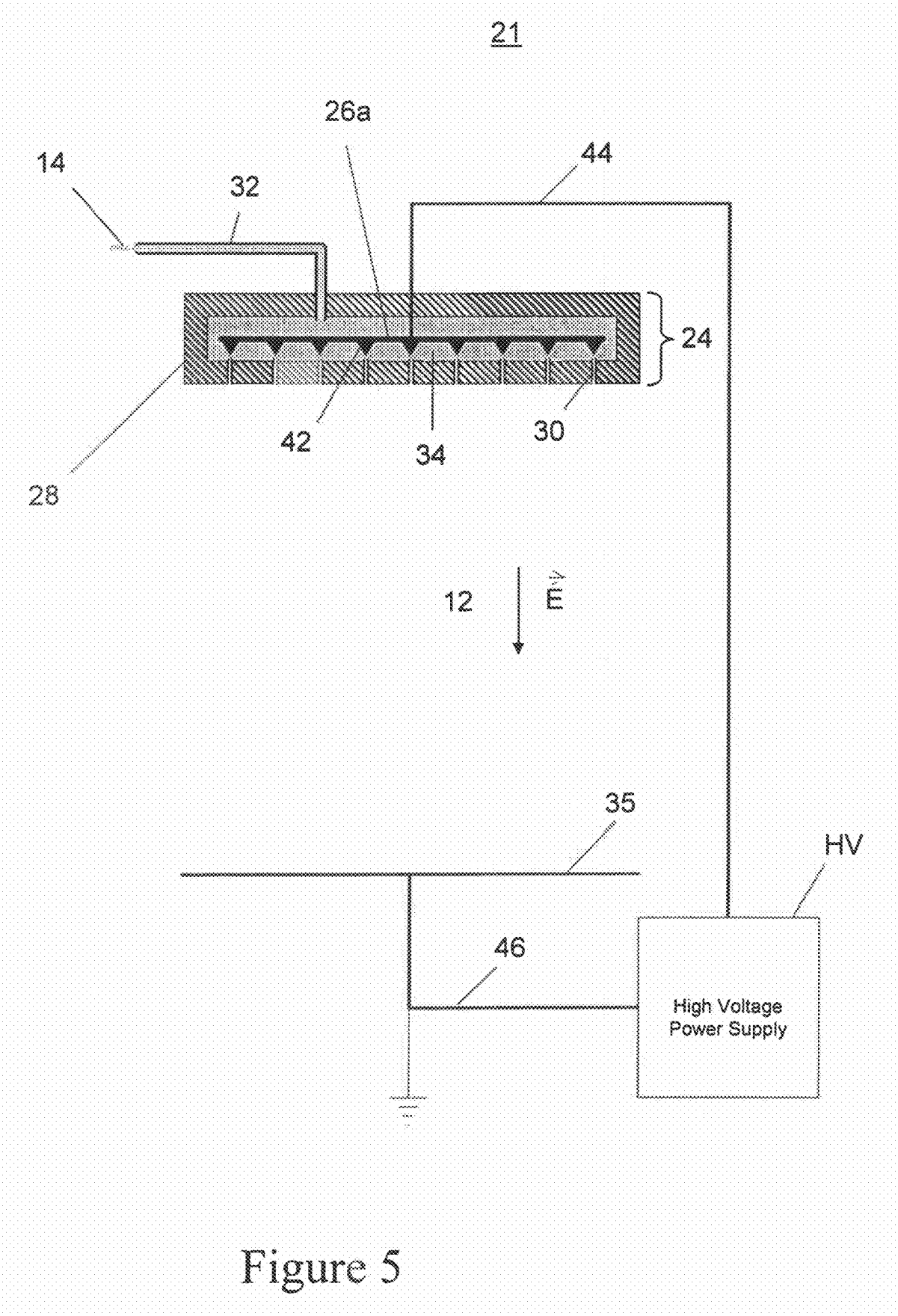
FIG. 5 is a schematic illustration of an electrospray/electrospinning apparatus according to another embodiment of the present invention.

The use of the electrode 26 in a configuration with multiple extrusion elements 30 permits a high throughput without the complexity of selectivity controlling electric fields singularly at each extruding element. Further, FIG. 5 shows a variation employing an electrode 26*a* having a surface having a non-even geometry for the surface facing the elements 30. As before, the electrode 26*a* is configured to drive multiple extrusion elements 30, but the electrode 26*a* has protrusions 42 preferably opposite to the individual extrusion elements 30, to increase the electric field intensity at the individual extrusion elements 30.

Figure 6A:
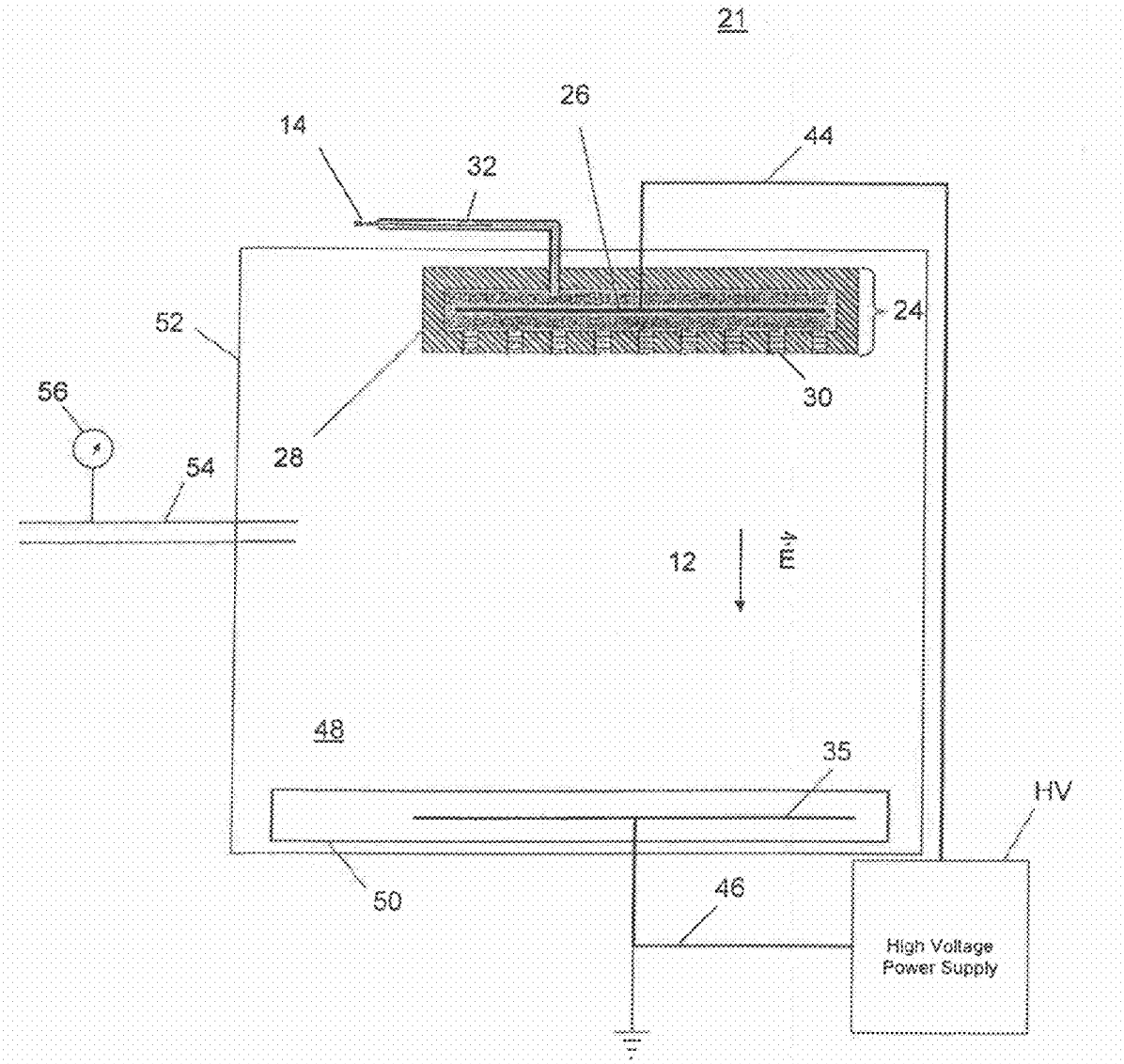
FIG. 6A is a schematic illustration of an electrospray/electrospinning apparatus enclosed in a chamber according to another embodiment of the present invention.

Further, according to another embodiment of the present invention, FIG. 6A shows an enclosure 28 that includes frits 30 as the extrusion elements. One frit 30 provides a conduction channel for the electrospray medium 14 in a similar fashion to the capillaries shown in FIG. 2.

The electrode 26 in the embodiment of FIG. 2 has a flat shape, as shown for example in FIG. 2. The flat electrode 26 electrifies the electrospray medium 14 in the enclosure 28. The electric field 12 extends from the electrode 26 through a wall of the enclosure 28 that includes the elements 30 to the exterior electrode 35 by applying a high voltage power source HV, as shown in FIG. 2. The high voltage power source HV could be any available DC power source, for example Bertan Model 105-20R (Bertan, Valhalla, N.Y.) or for example Gamma High Voltage Research Model ES30P (Gamma High Voltage Research Inc., Ormond Beach).

The high voltage source HV is connected to the electrode 26 through a lead 44 and to the exterior electrode 35 through another lead 46 as shown in FIG. 6A. The exterior electrode 35 is placed preferably 5 to 50 cm away from the electrode 26. The exterior electrode 35 can be a plate or a screen. Typically, an electric field strength between 2,000 and 400,000 V/m is established by the high voltage source.

Typically, the exterior electrode 35 is grounded, and the fibers produced by extrusion from the extrusion elements 30 are directed by the electric field 12 toward the exterior electrode 35. Electrospun fibers or electrosprayed fibrous materials in one embodiment of the present invention can be collected by a collecting mechanism such as a conveyor belt 50 as schematically shown in FIG. 6A. The collecting mechanism transfers the collected fibers or fibrous materials at a removal station 48 where the electrospinning fibers are removed from the belt 50 before the belt 50 returns to collect more fibers. The collecting mechanism 48 can be a separate piece of equipment or a combination of an electrode and a conveyor belt. The collecting mechanism can also use a mesh, a rotating drum or a foil instead of a belt for collecting the electrospun fibers or electrosprayed fibrous materials. In another embodiment, the electrospinning fibers are deposited on the exterior electrode 35, accumulate thereon, and are subsequently removed after a batch process.

The distance between the exterior electrode 35 and the electrode 26 is determined based on a balance of a few factors such as for example a time for the solvent evaporation rate, the electric field strength, and a distance/time sufficient for a reduction of the fiber diameter. These factors and their determination are similar in the present invention to those in conventional single needle spray elements. The present inventors have discovered that a rapid evaporation of the solvents results in larger than nm-size fiber diameters.

Therefore, in one embodiment of the present invention, the evaporation of the solvent is controlled by placing the enclosure 28 in a chamber 52 as shown in FIG. 6A in which a temperature, pressure and composition of the atmosphere is controlled.

Control of the gaseous environment about the extrusion elements 30 improves the quality of the fibers electrospun with regards to the distribution of nanofiber diameter and with regards to producing smaller diameter nanofibers. The present inventors have discovered that the introduction into the gaseous environment about the extrusion elements of electronegative gases such as for example carbon dioxide, sulfur hexafluoride, and freons, and gas mixtures including vapor concentration of solvents, ions, and/or charged particles improves the quality of electrospun fibers (i.e., the fibers are smaller in diameter and have a closer distribution of diameter sizes).

While electronegative gases such as carbon dioxide have been utilized in electrospraying to generate particles and droplets of material, no effects prior to the present work have been shown for the utilization of electronegative gases in an electrospinning environment. Indeed, the nature of electrospinning in which liberal solvent evaporation occurs in the environment about the extrusion elements and especially at the liquid droplet at the tip of the extrusion element would suggest that the addition of electronegative gasses would not influence the properties of the spun fibers.

Further, the differences in fluid properties of the polymer solutions utilized in electrospraying and those utilized in electrospraying, such as for example differences in conductivity, viscosity and surface tension, result in quite different gaseous environments about electrospraying and electrospinning apparatuses. For example, in the electrospray process, a fluid jet is expelled from a capillary at high DC potential and immediately breaks into droplets. The droplets may shatter when the evaporation causes the force of the surface charge to exceed the force of the surface tension (Rayleigh limit). Electrosprayed droplets or droplet residues migrate to a collection (i.e., typically grounded) surface by electrostatic attraction. Meanwhile in electrospinning, the highly viscous fluid utilized is pulled (i.e., expelled) as a continuous unit as an intact jet because of the inter-fluid attraction, and is stretched as the pulled fiber dries and undergoes the instabilities described below. The drying and expulsion process reduces the fiber diameter by at least 1000 times. In electrospinning, the present invention recognizes that the complexities of the process are influenced by the gaseous atmospheres surrounding the pulled fiber, if polymer solutions with relatively low viscosities and solids content are to be used to make very fine fibers (i.e., less than 100 nm in diameter).

Figure 1:
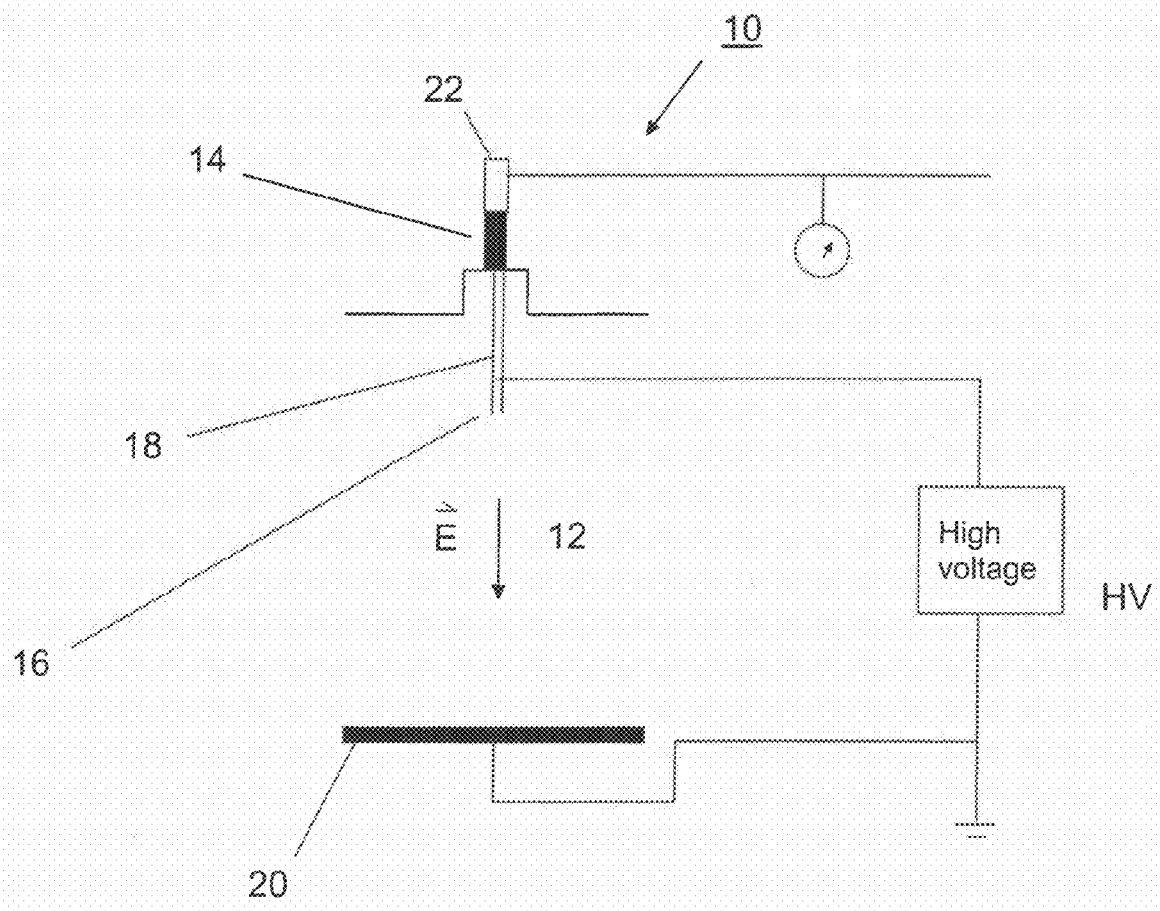
Figure 1 BACKGROUND ART
FIG. 1 is a schematic illustration of a conventional electrospinning apparatus.

With reference to FIG. 1, the electric field 12 pulls the polymer solution 14 as a filament or jet of fluid from a capillary (e.g., the tip 16 of the needle 18). A distinctive feature is observable at the tip referred to in the art as a Taylor's cone. As the liquid jet dries, the charge per specific area increases. Often within 2 or 3 centimeters from the tip of the capillary, the drying liquid jet becomes electrically unstable (i.e., a Rayleigh instability develops). The liquid jet while continuing to dry fluctuates rapidly stretching the fiber to reduce the charge density as a function of the surface area on the fiber.

By modifying the gaseous environment surrounding the capillary, the present invention permits increases in the applied voltage and improved pulling of the liquid jet from the capillary. In particular, electronegative gases appear to reduce the onset of a corona discharge around the capillary thus permitting operation at higher voltages enhancing the electrostatic force. The formation of corona around the capillary would disrupt the electrospinning process. Further, according to the present invention, insulating gases will reduce the possibility of bleed-off of charges in the Rayleigh instability region, thereby enhancing the stretching and drawing of the fiber. Cross-referenced related application U.S. application Ser. No. 10/819,945, entitled "Electrospinning in a Controlled Gaseous Environment," contains further details of controlling and modifying the gaseous environment during electrospinning.

The drying rate for the electrospun fiber during the electrospining process can be adjusted by altering the partial pressure of the liquid vapor in the gas surrounding the fiber. Retarding the drying rate would be advantageous because the longer the residence time of the fiber in the region of instability the more prolonged is the stretching, and consequently the smaller the diameter of the resultant fiber. The height of the containment chamber and separation of the capillary at high DC voltage from the ground need, according to the present invention to be compatible with the drying rate of the fiber. Also the DC voltage is preferably adjusted to maintain an electric field gradient of about 3 KV/cm.

As illustrative of the electrospinning process of the present invention, the following non-limiting examples are given to illustrate selection of the polymer, solvent, extrusion element to collection surface separation, solvent pump rate, and addition of electronegative gases. One illustrative example for selection, according to the present invention, of polymer, solvent, extrusion element, collection surface separation, solvent pump rate, and addition of electronegative gases is given below:

a polymer solution of a molecular weight of 350 kg/mol,
a solvent of dimethylformamide DMF,
an extrusion element tip diameter of 1000 μm,
an Al plate collector,
~0.5 ml/hr pump rate providing the polymer solution, an electronegative gas flow of $CO_2$ at 8 lpm, an electric field strength of 2 KV/cm, and a gap distance between the tip and the collector of 17.5 cm.

A decreased fiber size can be obtained by increasing the molecular weight of the polymer solution to 1000 kg/mol, and/or introducing a more electronegative gas (such as for example Freon), and/or increasing gas flowrate to for example 20 lpm, and/or decreasing the tip diameter to 150 μm (e.g. as with a Teflon tip).

Thus, the gaseous environment surrounding the extrusion elements during electrospinning influences the quality of the fibers produced. Indeed, the present inventors have observed that the electrospinning process can be started and stopped by turning on or off a supply of an electronegative gas. Blending gases with different electrical properties can be used to optimize performance. One example of a blended gas includes $CO_2$ (at 4 lpm) blended with Argon (at 4 lpm).

Further, when a solvent such as methylene chloride or a blend of solvents is used to dissolve the polymer, the rate of evaporation of the solvent will depend on the vapor pressure gradient between the fiber and the surrounding gas. The rate of evaporation of the solvent can be controlled by altering the concentration of solvent vapor in the gas. The rate of evaporation affects the Rayleigh instability. In turn, the electrical properties of the solvent and its vapor influence the electrospinning process. For example, by maintaining a liquid solvent pool at the bottom of a chamber, the amount of solvent vapor present in the ambient about the electrospinning is controlled by altering the temperature of the chamber and/or pool, and thus controlling the partial pressure of the solvent in the gaseous ambient about the electrospinning. Having a solvent vapor in the electrospinning chamber affects the drying rate of the fibers, and alters the fiber surface characteristics when a solvent other than the one used in spinning solution is used in the chamber.

While the effect of controlling the environment about an electrospinning extrusion element has been illustrated by reference to FIG. 1, control of the environment is important to other electrospinning apparatuses, such as for example the apparatuses shown in FIGS. 2 and 5 of the present invention.

Further, FIG. 6A shows a chamber 52 enclosing the enclosure 28. A pipe 54 is connected to an external gas source (not shown), and maintains through a prescribed gas flow a controlled atmosphere inside the chamber 52 at a certain temperature and pressure 56. The chamber 52 can be a hermetically closed chamber in which the enclosure 28, the exterior electrode 35, and other parts of the apparatus described in FIGS. 2 and 5 are placed, or the chamber 52 can be a chamber venting the gas from the chamber.

Figure 6B:
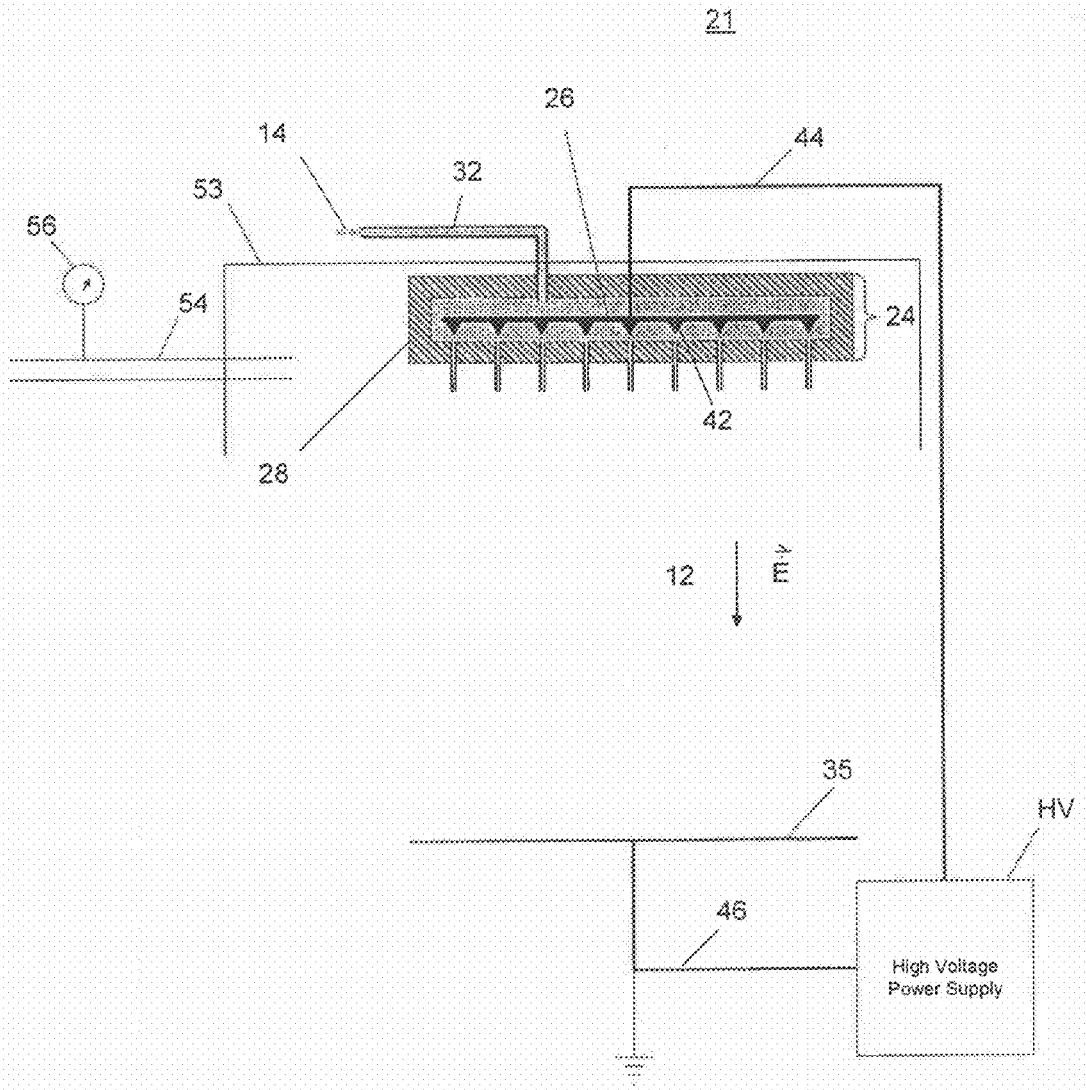
FIG. 6B is a schematic illustration of an electrospray/electrospinning apparatus having a shroud according to another embodiment of the present invention.

FIG. 6B shows an example in which a shroud 53 encloses the spray head 24 such to allow the control of the atmospheric composition around each of the elements 30. The shroud 53 can be placed inside a chamber 52, if desired to further control the temperature and pressure around each of the elements 30.

Figure 7:
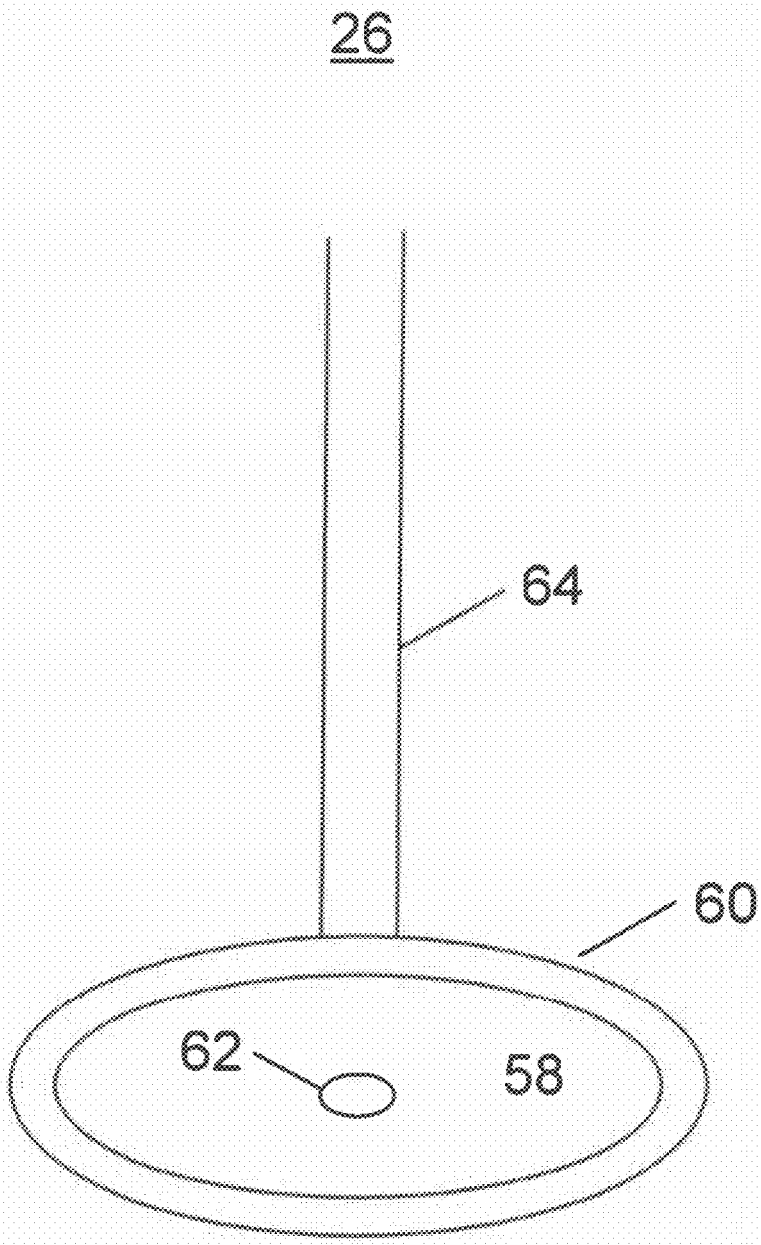
FIG. 7 is a schematic illustration showing a perspective view of a common electrode of the electrospray/electrospinning apparatus according to one embodiment of the present invention.
Figure 8:
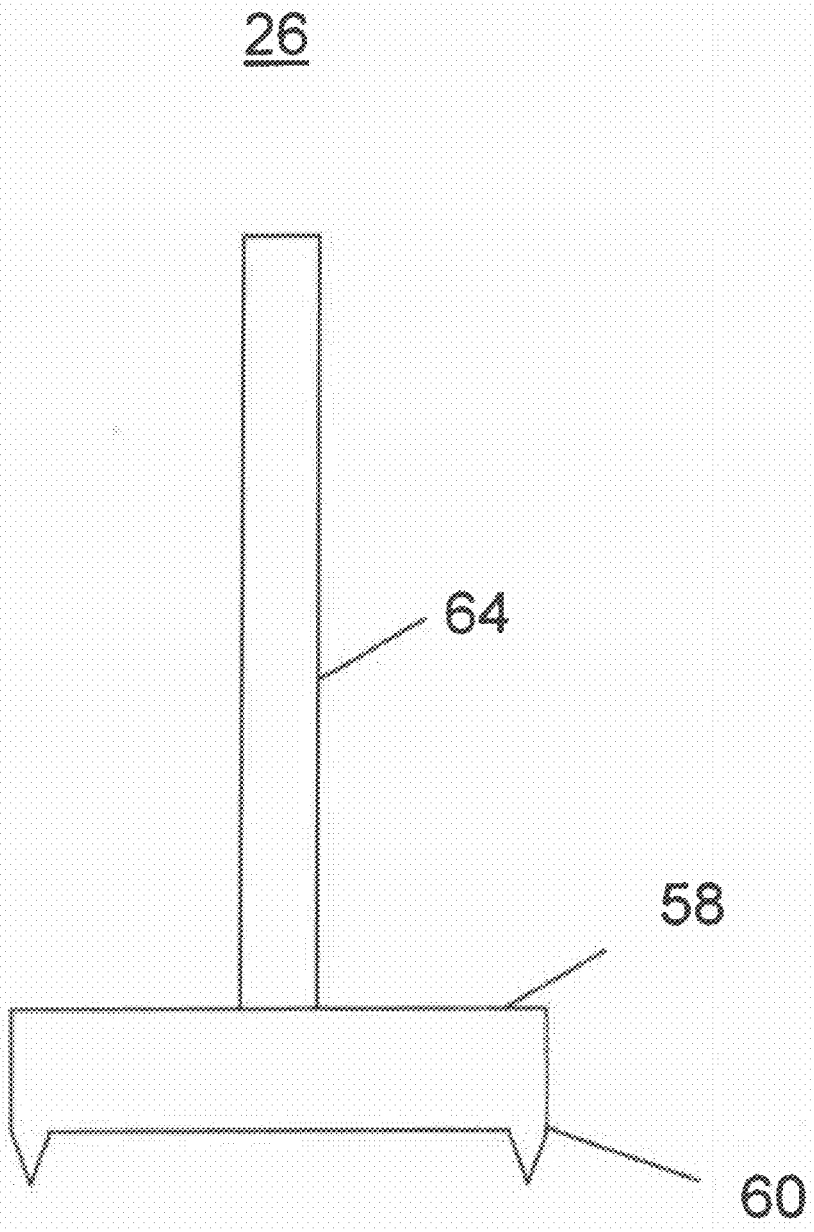
FIG. 8 is a schematic illustration showing a side view of the common electrode of FIG. 7.

A non-planar electrode configuration is shown in FIGS. 7 and 8. The geometry shown in FIGS. 7 and 8 is a non-limiting example of an electrode configuration beyond a strictly flat planar arrangement. The electrode 26 shown in FIGS. 7 and 8 includes a circular disk 58 having a planar geometry with a lip 60 (i.e., a peripheral rim) formed around the circular disk 58 and having a hole 62 formed in the middle of the circular disk 58. The present inventors have discovered that the lip 60 improves the quality of the electrospinning fibers produced by reducing the electric field strength needed for electrospinning. The lip 60 preferably has a sharp free end as shown in FIG. 8. The hole 62 connects the circular disk 58 to, for example, a tube 64. In this example, the tube has an inner diameter of about 0.75 to 0.175 cm, an outer diameter of about 0.28 cm, and a length of about 2.6 cm. A height of the lip 60 is about 0.20 cm, and a thickness of the lip is around 0.125 cm. The circular disk 58 has an outer diameter of about 1.5 cm, and a total length of the electrode 26, including the tube 64 and the circular disk 58, is about 2.8 cm.

According to one embodiment of the present invention, the enclosure 28 can be made by micro-machining holes with an appropriate configuration in a flat or appropriate shaped plate of Al or silicon, which is subsequently oxidized to silicon dioxide. Lasers can be used according to the present invention to micro-machine the Al or silicon plate by selectively ablating nearly all the material within a focal spot of the laser beam before any significant heat conduction or mass flow takes place, thus enabling precise machining with little thermal damage. For example, using a Q-switched Nd: YAG and excimer lasers, a 60 fs laser with a 5 μm focused spot can produce holes as small 800 nm in $SiO_2$, and 300 nm diameter in metal films. Other lasers and fabrication techniques known to one skilled in the art and including but not limited to chemical etching and electromechanical machining can be used for micro-machining the enclosure 28 and other parts of the present invention.

For the purposes of an exemplary teaching, the electrode 26 with a plurality of extrusion elements, as depicted in FIG. 2, can be formed by the following procedure.

In this exemplary teaching, the electrode 26 can be formed from a piece of metal by a machining or turning process (e.g. turning a metal disc to an outside diameter of 1.75 cm and then slicing the disk and machining the sliced disk to a prescribed thickness, such a for example 0.25 cm). The metal can be a soft or refractory metal. Lead connections can be soldered or welded to the electrode.

Figure 9A:
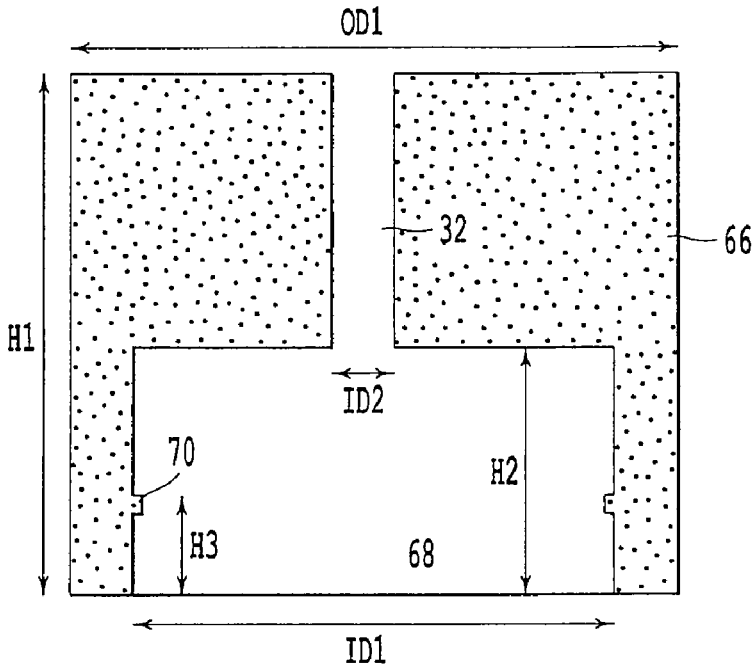
FIG. 9A is a schematic of one part of the enclosure of the electrospray/electrospinning apparatus of the present invention.

Having formed the electrode, the enclosure can be formed by the fabrication of two separate components. With reference to FIG. 9A, a first component 66 can be formed from for example an intrinsic (i.e. lightly doped) Si wafer or a silica disc. If the Si wafer or silica disc does not have an appropriate outside diameter, diamond turning can be used to set the outside diameter. Accordingly, the first component 66 is processed to remove interior portions to form a cavity 68, to provide the inner dimensions shown in FIG. 9A, and to provide the opening 32 through which the electrospray medium 14 will enter the enclosure. The first component 66 as shown in FIG. 9A can have an outer diameter OD1 of about 2.5 cm, an inner diameter ID1 of about 1.8 cm, and a height H1 of about 2 cm. The cavity 68 of the first component 66, as shown for example in FIG. 9A, can have a height H2 of about 1.8 cm. Further, the first component 66 has an interior passage 32 with a diameter ID2 of about 0.27 cm. Moreover, a stop 70 can be located at a level H3 of about 0.5 cm from a base of the first component. The stop 70 is sized to permit the electrode 26 to pass beyond the stop 70. The above-noted interior processing can use lithographic/etching techniques or the above-noted laser processing for machining the interior portions.

Figure 9B:
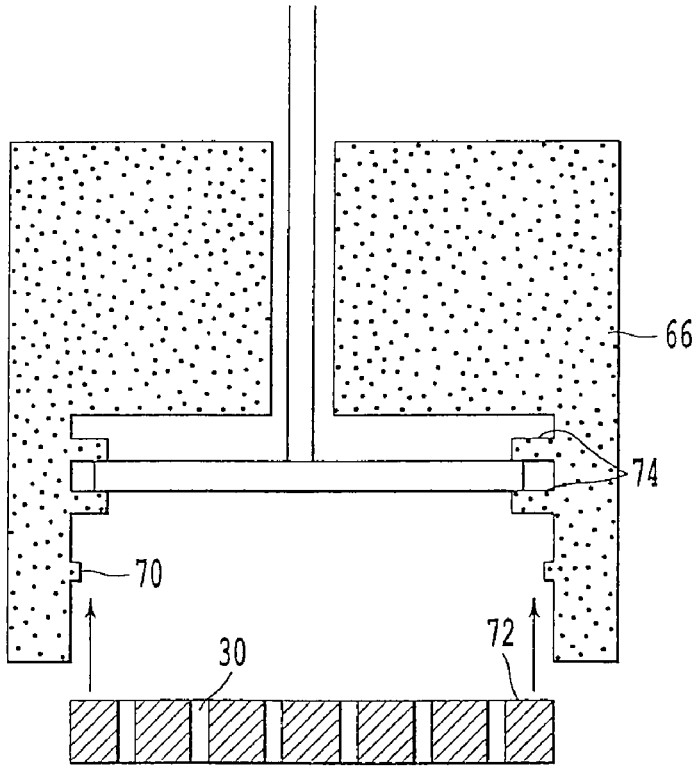
FIG. 9B is a schematic depicting assembly of the electrospray/electrospinning head according to one embodiment of the present invention.

Having now formed the first component 66 of the enclosure 28, the second component 72 (i.e., the wall of the enclosure 28 containing the extrusion elements 30) can be fabricated. Once again, an intrinsic Si wafer or a silica disc can be used. In either case, if the outside diameter is oversized, diamond turning or laser machining can be used to set the outside diameter for clearance of ID1 (i.e. under 1.8 cm). Laser drilling or lithography/etching can be used to form an array of openings in the second component 72 as shown in FIG. 9B. As noted earlier, these openings are machined in the second component 72 to accept one of a variety of tubes, capillaries, and/or frits to form the extrusion elements 30.

Having the major pieces of the spray head 24 fabricated, the electrode 26 is inserted into the cavity 68 beyond the stop 70. Rubber stops 74 can be used to locate the electrode 26 above and below the stop 70 as shown in FIG. 9B. The electrode 26 has an outer diameter such to pass the stop 70. Relief in the side walls of the cavity 68 or slits in the electrode 26 can facilitate flow of the electrospray medium around the electrode 26. The second component 72 of the enclosure is then inserted into the first component and abuts the stop 70 to complete the electrospray head 28. As noted previously, if both the first and second components are made of silicon, then an oxidation reactor can join these together. Alternatively, a sealant such as silicone rubber, screws or other known methods can be used to join the first component to the second component.

Other materials besides those described above can be used to fabricate the spray head. For example, the present inventors have found that plastics and polytetrafluoroethylene can be used for the first component 66 of the enclosure and as well as the second component 72. Further, silicone rubber can be used as well for these components. If a rubber wall is used for the second component 72, then the rubber wall can be cut slightly larger than the opening of the first component 66 to frictionally fit the first component 66. Moreover, the extrusion elements 30 can be manufactured for example from commercially available glass tubes that are thinned to a desired inside dimension, cut into pieces and inserted into the rubber wall.

Figure 10:
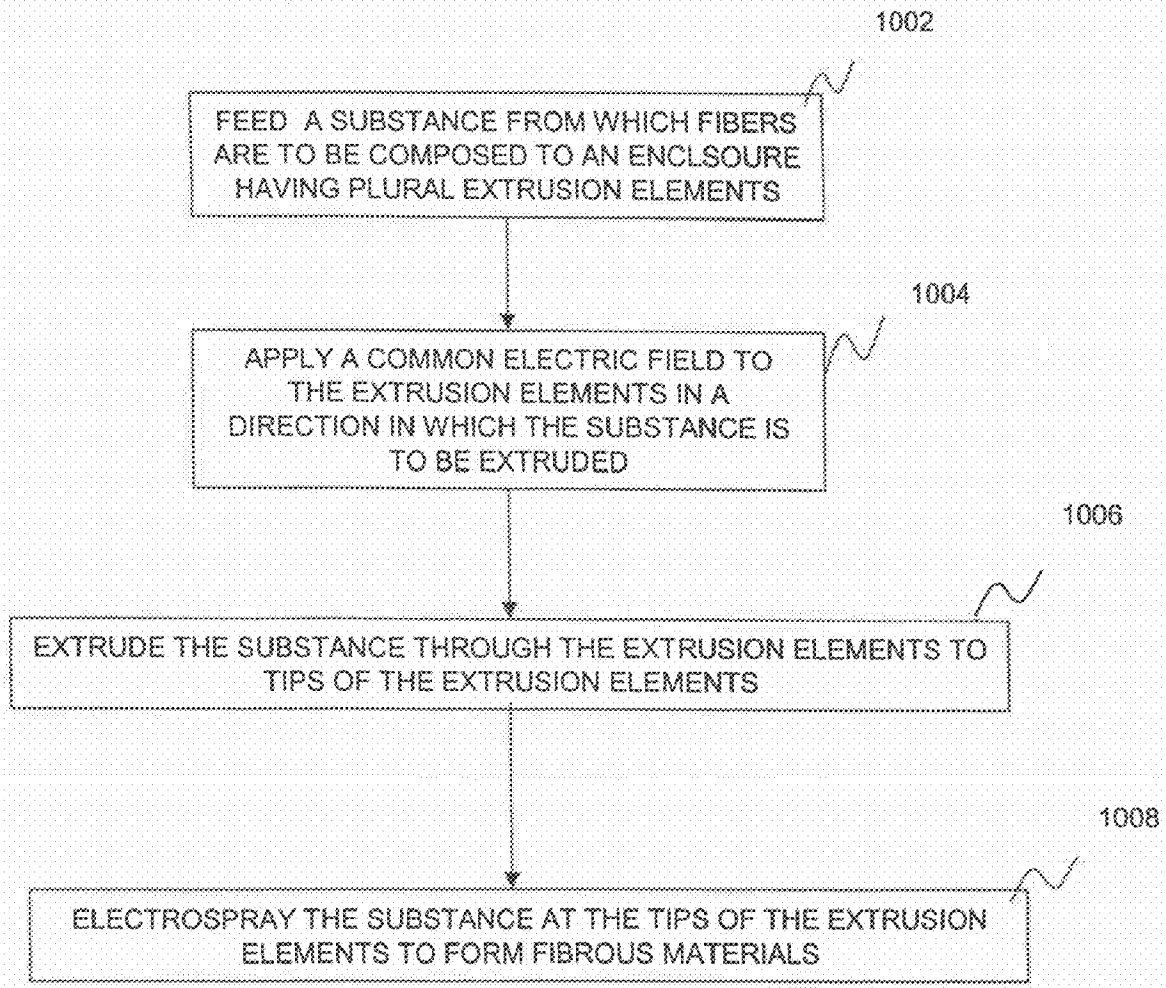
FIG. 10 is a flowchart depicting a method of the present invention.

Thus, the present invention provides various apparatuses and methods for producing fibrous materials. As depicted in FIG. 10, method at step 1002 feeds a substance from which the fibrous materials are to be composed to the enclosure having the plural extrusion elements, at step 1004 applies a common electric field to the extrusion elements in a direction in which the substance is to be extruded, at step 1006 extrudes the substance through the extrusion elements to tips of the extrusion elements, and at step 1008 electrosprays the substance at the tips of the plural extrusion elements to form the fibrous materials.

The electrospraying can electrospin the extruded substance from the plural extrusion elements to form fibers or nanofibers. The electrospraying preferably occurs in an electric field strength of 2,000-400,000 V/m. The fibrous materials electrosprayed from the extrusion elements are collected on a collector. The fibers electrospun from the extrusion elements can also be collected on a collector. The fibers produced can be nanofibers.

The fibers and nanofibers produced by the present invention include, but are not limited to, acrylonitrile/butadiene copolymer, cellulose, cellulose acetate, chitosan, collagen, DNA, fibrinogen, fibronectin, nylon, poly(acrylic acid), poly (chloro styrene), poly(dimethyl siloxane), poly(ether imide), poly(ether sulfone), poly(ethyl acrylate), poly(ethyl vinyl acetate), poly(ethyl-co-vinyl acetate), poly(ethylene oxide), poly(ethylene terephthalate), poly(lactic acid-co-glycolic acid), poly(methacrylic acid) salt, poly(methyl methacrylate), poly(methyl styrene), poly(styrene sulfonic acid) salt, poly(styrene sulfonyl fluoride), poly(styrene-co-acrylonitrile), poly(styrene-co-butadiene), poly(styrene-co-divinyl benzene), poly(vinyl acetate), poly(vinyl alcohol), poly(vinyl chloride), poly(vinylidene fluoride), polyacrylamide, polyacrylonitrile, polyamide, polyaniline, polybenzimidazole, polycaprolactone, polycarbonate, polydimethylsiloxane-co-polyethyleneoxide, polyetheretherketone, polyethylene, polyethyleneimine, polyimide, polyisoprene, polylactide, polypropylene, polystyrene, polysulfone, polyurethane, polyvinylpyrrolidone, proteins, SEBS copolymer, silk, and styrene/isoprene copolymer.

Additionally, polymer blends can also be produced as long as the two or more polymers are soluble in a common solvent. A few examples would be: poly(vinylidene fluoride)-blend-poly(methyl methacrylate), polystyrene-blend-poly(vinylmethylether), poly(methyl methacrylate)-blend-poly(ethyleneoxide), poly(hydroxypropyl methacrylate)-blend poly (vinylpyrrolidone), poly(hydroxybutyrate)-blend-poly (ethylene oxide), protein blend-polyethyleneoxide, polylactide-blend-polyvinylpyrrolidone, polystyrene-blend-polyester, polyester-blend-poly(hyroxyethyl methacrylate), poly(ethylene oxide)-blend poly(methyl methacrylate), poly (hydroxystyrene)-blend-poly(ethylene oxide)).

By post treatment annealing, carbon fibers can be obtained from the electrospun polymer fibers.

Numerous modifications and variations of the present invention are possible in light of the above teachings. It is therefore to be understood that within the scope of the appended claims, the invention may be practiced otherwise than as specifically described herein.

The invention claimed is:

1. A method for producing fibrous materials, comprising:

feeding a substance from which the fibrous materials are to be composed to an enclosure having at least one extrusion element, said at least one extrusion element including at least one frit segment entirely covering an opening in the extrusion element;

applying a common electric field to said extrusion element in a direction in which said substance is to be extruded;

extruding said substance through said extrusion element including said at least one frit segment; and electrospraying said substance at the tips of said plural extrusion elements to form said fibrous materials.

2. The method of claim 1, wherein said electrospraying comprises:

electrospinning said extruded substance from said at least one extrusion element to form fibers.

3. The method of claim 1, wherein said electrospraying comprises:

electrospinning said extruded substance from said at least one extrusion element to form nanofibers.

4. The method of claim 1, wherein said electrospraying comprises:

electrospinning said fibrous materials in said common electric field having a strength of 2,000-400,000 V/m.

5. The method of claim 1, further comprising:

collecting said fibrous materials on a collector.

6. The method of claim 5, wherein said collecting comprises:

collecting fibers of said extruded substance.

7. The method of claim 1, wherein the electrospraying comprises:

electrospinning polymeric fibers.

8. The method of claim 7, further comprising:

annealing said polymeric fibers to form carbon fibers.

9. The method of claim 1, wherein the electrospraying comprises:

electrospinning polymeric nanofibers.

10. The method of claim 9, further comprising:

annealing said polymeric nanofibers to form carbon nanofibers.

* * * * *